US007073440B2

(12) United States Patent
Langlais, II et al.

(10) Patent No.: US 7,073,440 B2
(45) Date of Patent: Jul. 11, 2006

(54) PRINTING MEMBERS HAVING SOLUBILITY-TRANSITION LAYERS AND RELATED METHODS

(75) Inventors: Eugene L. Langlais, II, Amherst, NH (US); Kenneth R. Cassidy, Goffstown, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 11/090,711

(22) Filed: Mar. 25, 2005

(65) Prior Publication Data

US 2005/0247226 A1 Nov. 10, 2005

Related U.S. Application Data

(60) Provisional application No. 60/557,113, filed on Mar. 26, 2004.

(51) Int. Cl.
*B41N 1/08* (2006.01)
*B41N 3/00* (2006.01)
*B41C 1/10* (2006.01)

(52) U.S. Cl. ..... 101/467; 101/463.1; 101/464; 101/465; 101/454; 430/270.1; 430/300; 430/302

(58) Field of Classification Search ..... None
See application file for complete search history.

(56) References Cited

U.S. PATENT DOCUMENTS 4,113,912 A * 9/1978 Okita ..... 442/118
5,638,753 A 6/1997 Lewis et al.
5,778,790 A 7/1998 Peterson
5,922,502 A 7/1999 Damme et al.
5,948,596 A 9/1999 Zhong et al.
5,985,514 A 11/1999 Zheng et al.
6,030,750 A 2/2000 Vermeersch et al.
6,060,217 A 5/2000 Nguyen et al.
6,096,481 A 8/2000 Vermeersch et al.
6,165,685 A 12/2000 Maerz et al.
6,182,569 B1 2/2001 Rorke et al.
6,182,570 B1 2/2001 Rorke et al.
6,214,515 B1 4/2001 Van Damme et al.
6,352,812 B1 3/2002 Shimazu et al.
6,357,352 B1 3/2002 Rorke et al.
6,374,738 B1 4/2002 Lewis
6,378,432 B1 4/2002 Lewis
6,427,595 B1 8/2002 Van Damme et al.
6,490,975 B1 * 12/2002 Rorke et al. ..... 101/467
6,497,178 B1 * 12/2002 Rorke et al. ..... 101/457
2002/0072013 A1 6/2002 Vander Aa.
2002/0162469 A1 * 11/2002 Harwood, Jr. ..... 101/467

FOREIGN PATENT DOCUMENTS

EP 1 151 858 A2 11/2001
EP 1 211 065 A2 6/2002

* cited by examiner

*Primary Examiner*—Ren Yan
*Assistant Examiner*—Joshua Zimmerman
(74) *Attorney, Agent, or Firm*—Goodwin Procter LLP

(57) ABSTRACT

Solubility transitions rather than ablation mechanisms facilitate selective removal of the imaging layer of a lithographic plate, which allows for imaging with low-power lasers that need not impart ablation-inducing energy levels.

73 Claims, 8 Drawing Sheets

PRINTING MEMBERS HAVING SOLUBILITY-TRANSITION LAYERS AND RELATED METHODS

CROSS-REFERENCE TO RELATED APPLICATION

This application claims priority to, and the benefits of, U.S. Provisional Application Ser. No. 60/557,113, filed on Mar. 26, 2004, the entire disclosure of which is hereby incorporated by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the wetted printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems generally rely on removal of an energy-absorbing layer from the lithographic plate to create an image. Exposure to laser radiation may, for example, cause ablation—i.e., catastrophic overheating—of the ablated layer in order to facilitate its removal. Accordingly, the laser pulse must transfer substantial energy to the absorbing layer. This means that even low-power lasers must be capable of very rapid response times, and imaging speeds (i.e., the laser pulse rate) must not be so fast as to preclude the requisite energy delivery by each imaging pulse.

DESCRIPTION OF THE INVENTION

Brief Summary of the Invention

The present invention utilizes solubility transitions rather than ablation mechanisms to facilitate selective removal of the imaging layer of a lithographic plate, which allows for imaging with low-power lasers that need not impart ablation-inducing energy levels. In a first aspect, the invention involves a printing member having a first layer that is permeable to an aqueous solution, a second layer thereunder, and a substrate beneath the second layer. At least a portion of the second layer undergoes a transition from an insoluble state to a soluble state in response to heat; the change in solubility may be with respect to water or another solvent. The substrate and the first layer can have the same or opposite affinities for ink and/or a liquid to which ink will not adhere. In addition, the first and second layers can have the same or opposite affinities for ink and/or a liquid to which ink will not adhere.

The transition the second layer undergoes may involve a transition from a crystalline state to an amorphous state. Polyvinyl alcohol is a suitable material for this purpose. Substantially all, or only a portion of the second layer exposed to the imaging radiation may undergo the transition. The substrate may be fabricated from a metal or a polymer. The first layer may contain a material, such as a pigment or dye, that absorbs imaging radiation and transfers thermal energy to the second layer. Alternatively, the second layer may contain such a pigment or dye, or it may be present in both layers.

In some embodiments, the printing member contains a third layer between the second layer and the substrate. The printing member may contain a top layer above the first layer that is permeable to a solvent (e.g., an aqueous fluid), is transparent to imaging radiation, and has the same affinity as the first layer for ink and/or a liquid to which ink will not adhere.

In another aspect, the invention involves a method of imaging the lithographic printing member described above. The printing member is exposed to imaging radiation in an imagewise pattern, which causes at least a portion of the second layer exposed to the radiation to undergo a transition from an insoluble state to a soluble state. The printing member is next subjected to a solvent (e.g., an aqueous fluid), which permeates the first layer and dissolves the soluble portions of the second layer. The portions of the first layer that received radiation can then be removed, creating an imagewise lithographic pattern on the printing member.

In yet another aspect, the invention involves a printing member having an imaging layer which, in response to heat, undergoes a transition from an insoluble state to a soluble state, and a substrate thereunder. The imaging layer and the substrate can have the same or opposite affinities for ink and/or a liquid to which ink will not adhere.

The transition that the imaging layer undergoes may involve a transition from a crystalline state to an amorphous state. Substantially all, or only a portion of the imaging layer exposed to the imaging radiation may undergo the transition. The substrate may be fabricated from a metal or a polymer. The imaging layer may contain a material, such as a pigment and/or a dye, that absorbs imaging radiation.

In some embodiments, the printing member contains an intermediate layer between the imaging layer and the substrate. The imaging and intermediate layers have opposite affinities for ink and/or a liquid to which ink will not adhere. The printing member may contain a top layer above the imaging layer that is permeable to a solvent, is transparent to imaging radiation, and has the same affinity as the imaging layer for ink and/or a liquid to which ink will not adhere.

In another aspect, the invention involves a method of imaging the lithographic printing member described above. The printing member is exposed to imaging radiation in an imagewise pattern, which causes the portions of the imaging layer that receive the radiation to undergo a transition from an insoluble state to a soluble state. The printing member is next subjected to an aqueous fluid, which dissolves the soluble portions of the second layer. The portions of the imaging layer that received radiation can then be removed, creating an imagewise lithographic pattern on the printing member.

It should be stressed that, as used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention when taken in conjunction with the accompanying drawings, in which.

Figure 1:
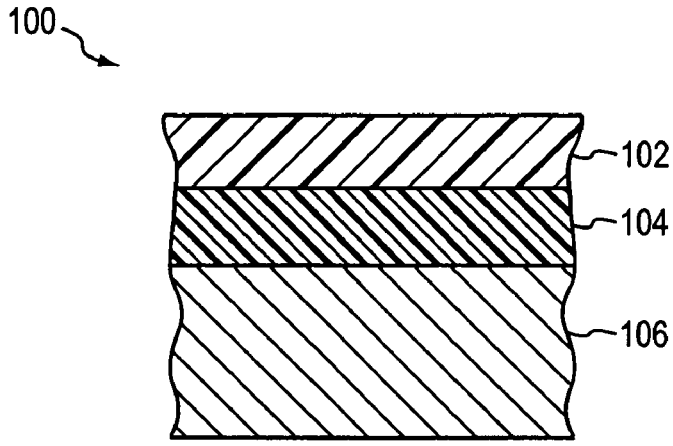
FIG. 1 is an enlarged sectional view of an embodiment of a printing member according to the invention that contains a first layer, a second layer, and a substrate.

The drawings and elements thereof may not be drawn to scale.

DETAILED DESCRIPTION OF THE PREFERRED EMBODIMENTS

1. Imaging Apparatus

An imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the infrared (IR) or near-IR region are fully described in U.S. Pat. No. Re. 35,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, in an array-type system for on-press applications it is generally preferable to employ a plurality of lasers and guide their outputs to a single writing array. The writing array is then shifted, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

2. Three-Layer Lithographic Printing Members

Figure 2:
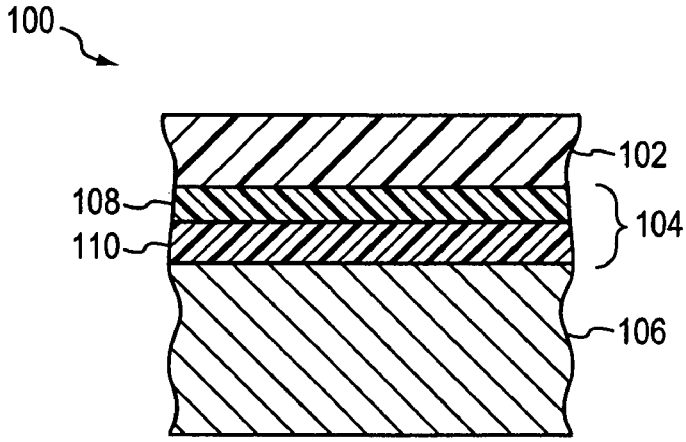
FIG. 2 is an enlarged sectional view of the printing member of FIG. 1, wherein only a portion of the second layer exposed to imaging radiation undergoes a transition.
Figure 3:
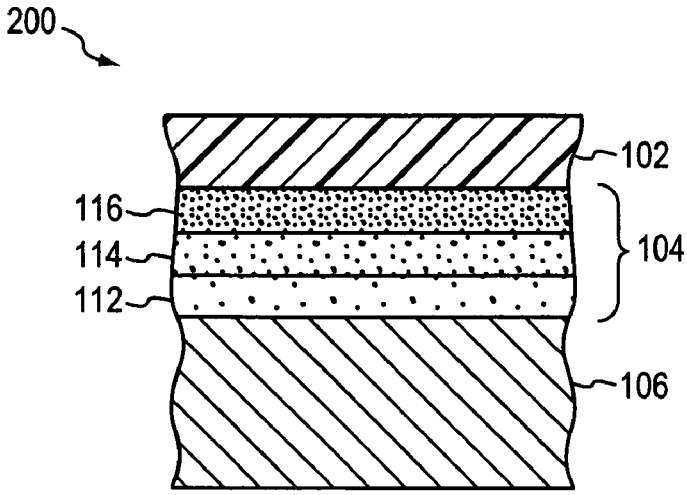
FIG. 3 is an enlarged sectional view of an embodiment of a printing member according to the invention that contains a first layer, a second layer which includes a plurality of sub-layers, and a substrate.
Figure 4:
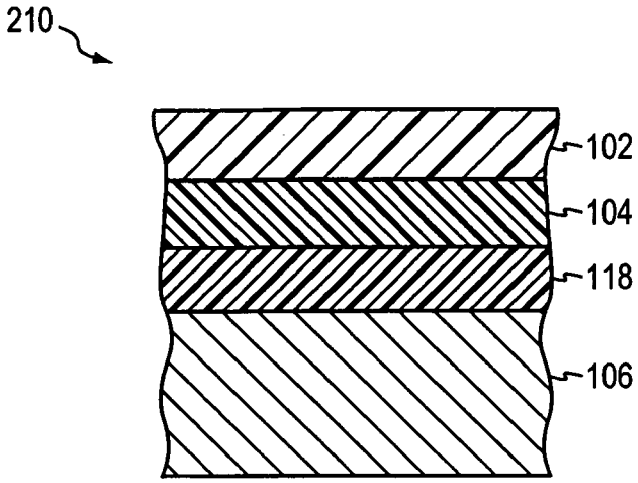
FIG. 4 is an enlarged sectional view of an embodiment of a printing member according to the invention that contains a first layer, a second layer, a third layer, and a substrate.
Figure 5:
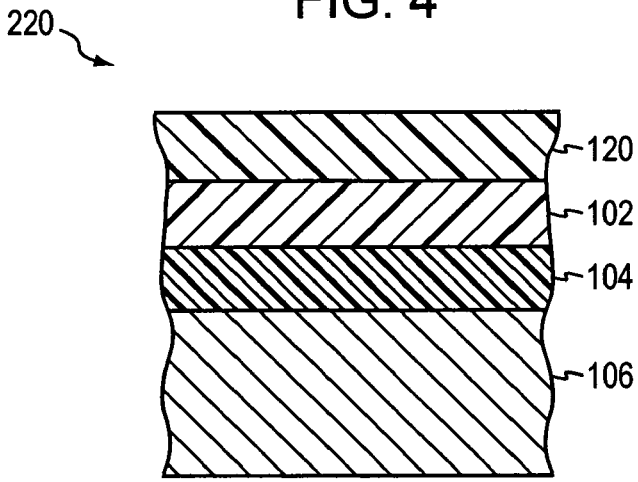
FIG. 5 is an enlarged sectional view of an embodiment of a printing member according to the invention that contains a top layer, a first layer, a second layer, and a substrate.
Figure 6:
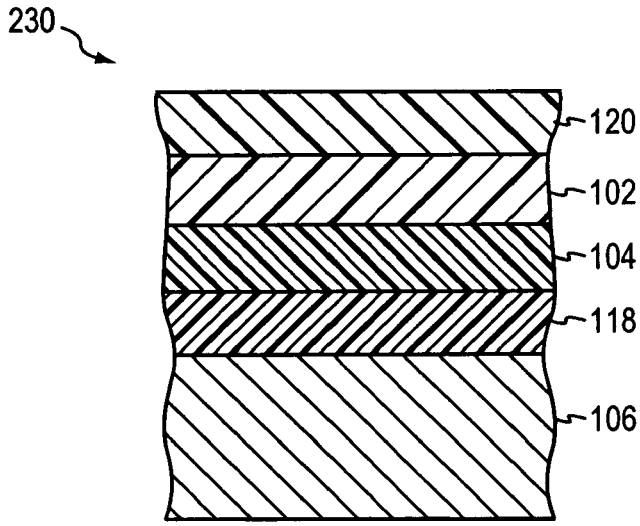
FIG. 6 is an enlarged sectional view of an embodiment of a printing member according to the invention that contains a top layer, a first layer, a second layer, a third layer, and a substrate.

FIGS. 1–3 illustrate embodiments 100, 200 of printing members according to the invention that include a solvent-permeable first layer 102, a second layer 104 that undergoes a transition in response to heat, and a substrate 106. FIG. 4 illustrates a variation 210 that includes a third layer 118 located between the second layer 104 and the substrate 106. FIG. 5 illustrates yet another variation 220 that includes a solvent-permeable top layer 120 that is transparent to imaging radiation. FIG. 6 illustrates a third variation 230 that includes both a third layer 118 and a solvent-permeable top layer 120. These layers and their functions will now be described in detail.

2.1. First Layer 102

The first layer 102 includes a polymer that is permeable to a solvent such as water and yet resistant to solubilization by such solvents. In general, this layer acts as a protective barrier above the second layer 104 and, if it is the top layer of the printing member, exhibits a lithographic affinity opposite to that of at least one layer below; for example, the first layer 102 may be oleophilic or hydrophilic. The first layer 102 may be transparent to imaging radiation, or may instead absorb imaging radiation so as to impart heat to the second layer 104, facilitating its transition. Polymers utilized in this layer should exhibit good adhesion to the second layer 104 and be highly wear-resistant. A cross-linking agent may be added to the first layer 102 to enhance these characteristics. Suitable polymers may be either water-based or solvent-based and can be oleophilic or hydrophilic. The first layer 102 may (but again, need not) include a material that absorbs imaging radiation and transfers thermal energy to the second layer 104.

Suitable polymers for an oleophilic first layer 102 include, but are not limited to, polyurethanes, cellulosic polymers such as nitrocellulose, polycyanoacrylates, and epoxy polymers. For example, polyurethane-based materials are typically extremely tough and may have thermosetting or self-curing capability. The first layer 102 may also be formed from a combination of one or more polymers, such as an epoxy polymer combined with a polyurethane polymer in the presence of a crosslinking agent and a catalyst, for example.

Suitable polymers for a hydrophilic first layer 102 include, but are not limited to, starch, dextran, alginic acid, and hydroxyethyl cellulose.

When IR or near-IR imaging radiation is employed, suitable absorbing materials can include a wide range of dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example. Any of these materials may be dispersed in a prepolymer before cross-linking into a final film. Alternatively, the absorber may be a chromophore chemically integral with the polymer backbone; see, e.g., U.S. Pat. No. 5,310,869.

The absorbing material should minimally affect adhesion between the first layer 102 and adjacent layers. Surface-modified carbon-black pigments sold under the trade designation CAB-O-JET 200 by Cabot Corporation, Bedford, Mass. are found to minimally disrupt adhesion at loading levels that provide adequate sensitivity for heating. Another suitable carbon-black pigment is BONJET BLACK CW-1, available from Orient Corporation, Springfield, N.J.

An exemplary first layer 102 may be prepared by mixing and coating methods known in the art, for example, combining a polyurethane polymer, an IR absorbing material (e.g., CAB-O-JET 200 carbon black), and hexamethoxymethylmelamine crosslinking agent in a suitable solvent, followed by the addition of a suitable amine-blocked p-toluenesulfonic acid catalyst to form the finished coating mix. The coating mix is then applied to the second layer 104 using one of the conventional methods of coating application, such as wire-wound rod coating, reverse roll coating, gravure coating, or slot die coating, and subsequently dried to remove the volatile liquids and to form a coating layer.

The first layer 102 is coated in this invention typically at a thickness in the range of from about 0.1 to about 20 microns and more preferably in the range of from about 0.1 to about 0.25 micron. After coating, the layer is dried and preferably cured at a temperature of between 145° C. and 165° C.

2.2 Second Layer 104

The second layer 104 layer captures the image on the printing member by undergoing a phase change or other physico-chemical transition from an insoluble state to a soluble state in response to heat. Polymers utilized in this layer should exhibit good adhesion to the first layer 102 above and to the substrate 106 or the third layer 118 below, and be highly wear-resistant. The second layer 104 may also include a material that absorbs imaging radiation.

The transition the second layer 104 undergoes in response to heat may involve a transition from an insoluble, crystalline state to a soluble, amorphous state. In one embodiment, the transition is reversible, which allows a printing member according to the invention to be "erased" and re-imaged. Erasure may be accomplished, for example, by heating an imaged plate in an oven and allowing it to cool slowly. It is believed that heating and slow cooling allows for recrystallization of the second layer 104 back to its insoluble state. Once cooled, the plate can be re-exposed to imaging radiation, and the new image will be revealed without any evidence of the first image. This "erasing" procedure can be repeated more than once.

Preferably, the unimaged portions of the second layer 104 withstand repeated application of fountain solution during printing without substantial degradation or solubilization. In particular, degradation of the second layer 104 may take the form of swelling of the layer and/or loss of adhesion to adjacent layers. This swelling and/or loss of adhesion may deteriorate the printing quality and dramatically shorten the press life of the printing member. One test of withstanding the repeated application of fountain solution during printing is a wet rub resistance test. Satisfactory results in withstanding the repeated application of fountain solution and not being excessively soluble in water or in a cleaning solution are the retention of the 3% dots in the wet rub resistance test.

In general, polymeric materials suitable for the second layer 104 include natural and non-natural polymers having exposed polar moieties such as hydroxyl or carboxyl groups. Examples of suitable polymers include, but are not limited to, polyethylene derivatives (such as polyethylene oxide), cellulose derivatives (such as hydroxyethyl cellulose and carboxymethyl cellulose), polyvinyl derivatives (such as polyvinyl alcohol and polyvinyl ether), polysaccharides (such as dextrin, dextran, and starch derivatives), polyglycolides, gelatines, and polyols, particularly crystalline. Suitable crystalline polyols include polyoxyalkylene polyols, the alkylene portion of which is a straight chain such as poly (oxyethylene) diol and poly(oxytetramethylene) diol; polyester polyols which are the reaction products of polyol(s) having from 2 to about 12 methylene groups and polycarboxylic acid(s) having from two to about 12 methylene groups; and polyester polyols made by ring-opening polymerization of lactones such as ϵ-caprolactone; and blends thereof. Preferred crystalline polyols include poly(oxytetramethylene) diol, polyhexamethylene adipate diol (made by reacting an excess of 1,6-hexamethylene diol and adipic acid), polyhexamethylene sebacate diol (made by reacting an excess of 1,6-hexamethylene diol and sebacic acid), and polyhexamethylene dodecanedioate diol (made by reacting an excess of 1,6-hexamethylene diol and dodecanedioic acid). Examples of commercially available crystalline polyols include, for example, poly(oxytetramethylene)polyols sold under the tradename TERATHANE (available from E.I. duPont de Nemours & Co.); polyester polyols sold under the tradenames LEXOREZ (available from Inolex Chemical Co.), RUCOFLEX (available from Ruco Polymer Corp.), and FORMREZ (available from Witco Chemical Co.); and polycaprolactone polyols sold under the tradename TONE (available from Union Carbide).

Other suitable polymers are straightforwardly identified by those of skill in the art, e.g., by reference to "Handbook of Water-Soluble Gums and Resins" by Robert L. Davidson (1980, McGraw-Hill Co.) (incorporated herein by reference). In a preferred embodiment, the second layer 104 includes polyvinyl alcohol.

Polymers with relatively low degrees of crystallinity may also be suitable for use in the second layer. For example, heating a polymer above its melting point followed by slow cooling may enhance the crystallinity of the polymer. Alternatively, reversibly cross-linking a polymer may lead to a more crystalline structure. For example, a high molecular weight polyacrylamide may be reversibly cross-linked via hydrogen bonding or multi-valent metals to form a water-insoluble, partially-crystalline state. Heat causes the cross-linked polymer to change phase from the water-insoluble, crystalline state to a water-soluble, amorphous state, allowing for image capture on the printing member.

In designing a suitable formulation, cross-linking can be used to control resolubility, filler pigments to modify and/or control rewettability, and pigments and/or dyes to impart absorbance of laser energy. In particular, fillers such as $TiO_2$ pigments, zirconia, silicas and clays are particularly useful in imparting rewettability without resolubility. In one embodiment, the second layer 104 contains a zirconium crosslinking agent, preferably ammonium zirconyl carbonate.

The second layer 104 may contain a material that absorbs imaging radiation. Near-IR absorbers for second layers 104 based on polyvinyl alcohol include conductive polymers, e.g., polyanilines, polypyrroles, poly-3,4-ethylenedioxypyrroles, polythiophenes, and poly-3,4-ethylenedioxythiophenes. As polymers, these are incorporated into the second layer 104 in the form of dispersions, emulsions, colloids, etc. due to their limited solubility.

Alternatively, they can be formed in situ from monomeric components included in the second layer 104 as cast or applied to the second layer 104 subsequent to the curing process, i.e., by a post-impregnation or saturation process. For conductive polymers based on polypyrroles, the catalyst for polymerization conveniently provides the "dopant" that establishes conductivity.

Certain inorganic absorbers, dispersed within the polymer matrix, also serve particularly well in connection with second layers 104 based on polyvinyl alcohol. These include TiON, TiCN, tungsten oxides of chemical formula $WO_{3-x}$, where $0<x<0.5$ (with $2.7\leqq x\leqq 2.9$ being preferred), and vanadium oxides of chemical formula $V_2O_{5-x}$, where $0<x<1.0$ (with $V_6O_{13}$ being preferred). Other suitable absorbing materials include dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example.

The second layer 104 is typically coated at a thickness in the range of from about 0.1 to about 40 microns and more preferably in the range of from about 0.1 to about 0.5 micron. After coating, the layer is dried and subsequently cured at a temperature between 135° C. and 185° C. for between 10 seconds and 3 minutes, and more preferably at a temperature between 145° C. and 165° C. for between 30 seconds and 2 minutes.

In one embodiment, substantially all of the second layer 104 exposed to the imaging radiation undergoes a transition from an insoluble state to a soluble state. Lithographic printing members according to this embodiment include a first layer 102 that has an affinity for ink and/or a liquid to which ink will not adhere that is opposite that of the substrate 106 and/or the optional third layer 118. In these embodiments, the second layer 104 can have either the same or opposite affinity as the first layer 102 for ink and/or a liquid to which ink will not adhere. However, it is preferable to provide a second layer 104 and a first layer 102 of like affinities because the second layer 104 will accept or reject ink in the same manner as the overlying first layer 102 in those areas where the first layer 102 is damaged during handling or the printmaking process, thus maintaining print quality and prolonging the press life of the printing member.

In another embodiment, only a portion of the second layer 104 exposed to imaging radiation undergoes the transition.

For example, with reference to FIG. 2, the imaging radiation may cause a first portion 108 of the second layer 104 (e.g., a portion of the second layer 104 near the first layer 102) to transition to a soluble state, while a second portion 110 of the second layer 104 (e.g., a portion of the second layer 104 near the substrate 106) remains in an insoluble state. Alternatively, the imaging radiation can cause a gradient of transformation to occur within the exposed portions of the second layer 104, whereby the second layer 104 changes gradually from substantially insoluble to highly soluble, with increasing intermediate solubility in between. In lithographic printing members wherein only a portion of the second layer 104 changes phase in response to imaging radiation, the first layer 102 and the second layer 104 have opposite affinities for ink and/or a liquid to which ink will not adhere, and the first layer 102, the substrate 106, and/or the optional third layer 112 may have the same or opposite affinities.

Various approaches can be used to create a phase stratification in a second layer 104. In one embodiment, the imaging radiation source is adjusted (e.g., by changing the frequency or the duration of the imaging pulse) to deliver only enough energy to cause a transition in a portion of the second layer 104. For example, in an embodiment of a lithographic printing member where a laser flux density in excess of 200 $mJ/cm^2$ causes the second layer to completely change phase or ablate, the radiation source can be tuned to deliver a lower laser flux density (e.g., 75–175 $mJ/cm^2$) to cause only a portion of the second layer to change phase.

Other embodiments involve manipulating the composition of the lithographic imaging member itself. For example, the concentration of radiation-absorbing material in the second layer 104 may be reduced, or a limited-stability absorber may be used, so that less heat is absorbed by the second layer 104. Limited-stability absorbers are compounds that break down in the presence of imaging radiation to form fragments that have little or no absorption capacity, thus imposing a ceiling on the temperature the second layer 104 may reach in response to the imaging radiation. Alternatively, the second layer 104 can be formed without any radiation-absorbing material at all, instead relying upon conduction from a first layer 102 that is able to convert the imaging radiation to heat. In this manner, the topmost portion of the second layer 104 near the first layer 102 is exposed to the heat, while lower portions of the second layer 104 near the substrate 106 receive little or no heat, resulting in solubility differences throughout the second layer 104.

In other embodiments, the second layer 104 contains a gradient of radiation-absorbing material that increases with distance from the substrate 106. One approach for forming such a gradient is to apply the second layer 104 to the substrate 106, and then add the radiation-absorbing material to the top of the second layer 104 before it cures. The radiation-absorbing material can then diffuse into the second layer 104, either due to gravity or by the application of an external force, creating a gradient of radiation-absorbing material throughout the second layer 104. In another embodiment, a gradient is produced by creating an initial uniform dispersion of the radiation-absorbing material, followed by controlled settling to concentrate the radiation-absorbing material toward one of the interfaces of the second layer 104. Alternatively, the second layer 104 can be a graded layer that is built up in successive stages. Referring to the embodiment 200 shown in FIG. 3, the second layer 104 includes a series of sub-layers 112, 114, and 116, each containing a different concentration of radiation-absorbing material. The first sub-layer 112 can be pre-mixed with the radiation-absorbing material prior to applying it to the substrate 106, or the radiation-absorbing material can be added after the first sub-layer 112 has been applied to the substrate 106 but before the first sub-layer 112 has cured. After the first sub-layer 112 has been applied, the application process is repeated for subsequent sub-layers 114 and 116, with each subsequent sub-layer including a higher concentration of radiation-absorbing material than the previous. Each subsequent sub-layer can be applied either before or after the previous sub-layer has cured. Delaying curing until the entire sequence of sub-layers has been applied can be more efficient and provide processing benefits. Although the second layer 104 in the illustrative embodiment 200 contains three sub-layers, it should be understood that a second layer 104 can include any number of sub-layers. In a related embodiment, different radiation-absorbing materials that have different absorption capacities can be included in the various sub-layers of the second layer 104 to produce the desired gradient effect. For example, dyes such as phthalocyanines and naphthalocyanines may have lower absorption capacities than pigments such as carbon black.

It should be understood that both the imaging radiation source and the lithographic printing member can be manipulated in combination to produce the desired transition in the second layer 104.

2.3 Substrate 106

The substrate 106 provides dimensionally stable mechanical support to the printing member and may dissipate heat accumulated in the second layer 104 to prevent its ablation. Suitable substrate materials include, but are not limited to, alloys of aluminum, chromium, and steel, which may have another metal such as copper plated over one surface. Preferred thicknesses range from 0.004 to 0.02 inch, with thicknesses in the range 0.005 to 0.012 inch being particularly preferred. Alternatively, substrate 106 may be paper or a polymer film (e.g., polyesters such as polyethylene terephthalate and polyethylene naphthalate, polycarbonates, polyurethane, acrylic, polyamide, or phenolic polymers). Preferred thicknesses for such films range from 0.003 to 0.02 inch, with thicknesses in the range of 0.005 to 0.015 inch being particularly preferred. When using a polyester substrate, it may prove desirable to interpose a primer coating between the second layer 104 and the substrate 106; suitable formulations and application techniques for such coatings are disclosed, for example, in U.S. Pat. No. 5,339,737, the entire disclosure of which is hereby incorporated by reference. It should be understood that any of the embodiments 100–230 may be fabricated with a metal, paper, polymer or other substrate material.

Non-image areas of the printing member have an affinity opposite to that of the image areas for ink and/or a liquid to which ink will not adhere. In embodiments of the invention wherein substantially all of the second layer 104 exposed to imaging radiation changes phase, the first layer 102 and the substrate 106 have opposite lithographic affinities. In embodiments that contain a third layer 118 (e.g. FIGS. 2 and 4), on the other hand, the first layer 102 and the substrate 106 need not have opposite lithographic affinities, because the first and third layers 102 and 118 have opposite affinities, as described below. However, it is preferable to provide a substrate 106 and a third layer 118 of like affinities to promote adhesion and to accommodate damage to the third layer 118 without loss of performance. Specifically, even though the third layer 118 is typically not soluble in aqueous solutions and is not removed during the imaging process, it can still be scratched or damaged during the printmaking process. A substrate 106 of like affinity will accept or reject ink in the same manner as the overlying third layer 118 in those areas where the third layer 118 is damaged, thus maintaining print quality and prolonging the press life of the printing member.

In embodiments of the invention wherein a only portion of the second layer 104 exposed to imaging radiation changes phase, the first layer 102 and the substrate 106 need not have opposite lithographic affinities, because the first and second layers 102 and 104 have opposite affinities, as described above. It is preferable, however, to provide a substrate 106 and a second layer 104 of like affinities to promote adhesion and to accommodate damage to the second layer 104 without loss of performance.

In general, a metal substrate must undergo special treatment in order to provide a hydrophilic surface. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water.

A structured or grained surface can also be produced by controlled oxidation, a process commonly called "anodizing." An anodized aluminum substrate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying second layer 104 in embodiments that do not include an intervening third layer 118.

Preferred hydrophilic substrate materials include aluminum that has been mechanically, chemically, and/or electrically grained with or without subsequent anodization. In addition, some metal layers need only be cleaned, or cleaned and anodized, to present a sufficiently hydrophilic surface.

A wide variety of papers may be utilized as a substrate 106. Typically, papers are saturated with a polymeric treatment to improve dimensional stability, water resistance, and strength during the wet lithographic printing.

Examples of suitable polymeric substrates 106 include, but are not limited to, polyesters such as polyethylene terephthalate and polyethylene naphthalate, polycarbonates, polystyrene, polysulfones, and cellulose acetate. Polymeric substrates 106 can further comprise a hydrophilic or oleophilic coating applied to at least one surface of a polymer film. A preferred polymeric substrate is polyethylene terephthalate film, such as the polyester films available under the trademarks of MYLAR and MELINEX from E. I. duPont de Nemours Co., Wilmington, Del., for example.

2.4 Optional Third Layer 118

With reference to FIGS. 4 and 6, the optional third layer 118 is located between the substrate 106 and the second layer 104 and provides a thermal barrier during laser exposure to prevent heat loss and possible damage to the substrate 106. The third layer 118 can be hydrophilic or oleophilic and should adhere well to the substrate 106 and to the second layer 104.

In embodiments of the invention wherein substantially all of the second layer 104 exposed to imaging radiation undergoes transition, the first layer 102 and the third layer 118 have opposite affinities for ink and/or a liquid to which ink will not adhere. In embodiments of the invention wherein a only portion of the second layer 104 exposed to imaging radiation undergoes transition, the first layer 102 and the third layer 118 need not have opposite lithographic affinities, because the first and second layers 102, 104 have opposite affinities, as described above. However, in these embodiments it is preferable to provide a third layer 118 and a second layer 104 of like affinities to promote adhesion and to accommodate damage to the remaining portion of the second layer 104 without loss of performance. For example, even though the remaining portion of the second layer 104 is not soluble in aqueous solutions and is not removed during the imaging process, it can still be scratched or damaged during the printmaking process. A third layer 118 of like affinity will accept or reject ink in the same manner as the overlying remnants of the second layer 104 in those areas where the second layer 104 is damaged, thus maintaining print quality and prolonging the press life of the printing member.

Preferably, the third layer 118 withstands repeated application of fountain solution during printing without substantial degradation or solubilization. In particular, degradation of the third layer 118 may take the form of swelling of the layer and/or loss of adhesion to the second layer 104 and/or to the substrate 106. This swelling and/or loss of adhesion may deteriorate the printing quality and dramatically shorten the press life of the printing member. A suitable third layer 118 will retain the 3% dots in the wet rub resistance test, as described above.

In general, polymeric materials suitable for a hydrophilic third layer 118 include those having exposed polar moieties such as hydroxyl or carboxyl groups such as various cellulosics modified to incorporate such groups, and polyvinyl alcohol polymers, for example. To provide water insolubility, polymeric reaction products of polyvinyl alcohol and crosslinking agents such as glyoxal, gluteraldehyde, p-toluene sulfonic acid, zinc carbonate, and the like are well known in the art. For example, the polymeric reaction products of polyvinyl alcohol and hydrolyzed tetramethylorthosilicate or tetraethylorthosilicate are described in U.S. Pat. No.3,971,660. However, it is preferred that the crosslinking agent have a high affinity for water after drying and curing the hydrophilic resin.

Suitable polyvinyl alcohol-based coatings for use in third layers 118 include, but are not limited to, combinations of AIRVOL 125 polyvinyl alcohol; BACOTE 20, a trademark for an ammonium zirconyl carbonate solution available from Magnesium Elektron, Flemington, N.J.; glycerol, available from Aldrich Chemical, Milwaukee, Wis.; and TRITON X-100, a trademark for a surfactant available from Rohm & Haas, Philadelphia, Pa. Typical amounts of BACOTE 20 utilized in crosslinking polymers are less than 5% by weight of the weight of the polymers.

Surprisingly, it has been found that significantly increased levels of BACOTE 20, such as 40% by weight, provide significant improvements in durability, in the ease of cleaning the laser-exposed areas, in adhesion to the ink-accepting areas of the plate during long press runs, and in the fine image resolution and printing quality that can be achieved. These results show that zirconium compounds such as BACOTE 20 have a high affinity for water when they are dried and cured at high loadings in a crosslinked coating containing polyvinyl alcohol. The high levels of BACOTE 20 also provide a hydrophilic third layer 118 which interacts with a subsequent coating application of the second layer 104 to further increase the insolubility and resistance to damage by laser radiation and by contact with water, a cleaning solution, or a fountain solution.

In one embodiment, a hydrophilic third layer 118 comprises ammonium zirconyl carbonate in an amount greater than 10% by weight based on the total weight of the polymers present in the layer. In another embodiment, a hydrophilic third layer 118 comprises ammonium zirconyl carbonate in an amount of 20 to 50% by weight based on the total weight of polymers present in the layer.

Examples of materials suitable for oleophilic third layers 118 include crosslinked polymer forms of polyurethanes, acrylics, polyamides, and phenolics, for example.

The third layer 118 typically has a thickness in the range of from about 1 to about 40 microns and more preferably in the range of from about 2 to about 25 microns. After coating, the layer is dried and subsequently cured at a temperature between 135° C. and 185° C. for between 10 seconds and 3 minutes, and more preferably at a temperature between 145° C. and 165° C. for between 30 seconds and 2 minutes.

2.5 Optional Top Layer 120

With reference to FIGS. 5 and 6, the optional top layer 120 is located above the first layer 102 and is designed to be more robust on press and more scratch-resistant than the first layer 102, thus maintaining print quality and prolonging the press life of the printing member. The top layer 120 includes a polymer that is permeable to water (or other solvent) and yet resistant to solubilization by aqueous solvents. Polymers utilized in this layer are generally transparent to imaging radiation and have the same affinity as the first layer 102 for ink and/or a liquid to which ink will not adhere.

Suitable polymers for the top layer 120 include hydroxy-functional, carboxy-functional, or epoxy-functional polymers, for example. The polymers are cross-linked to a greater extent than those in the first layer 102 to provide added durability while maintaining sensitivity to the imaging radiation.

3. Two-Layer Lithographic Printing Members

Figure 7:
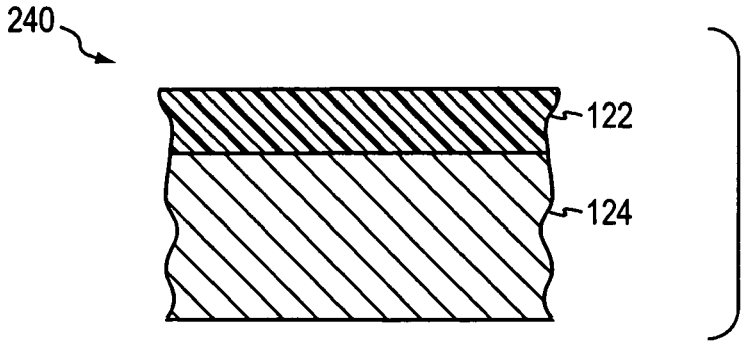
FIG. 7 is an enlarged sectional view of an embodiment of a printing member according to the invention that contains an imaging layer and a substrate.
Figure 8:
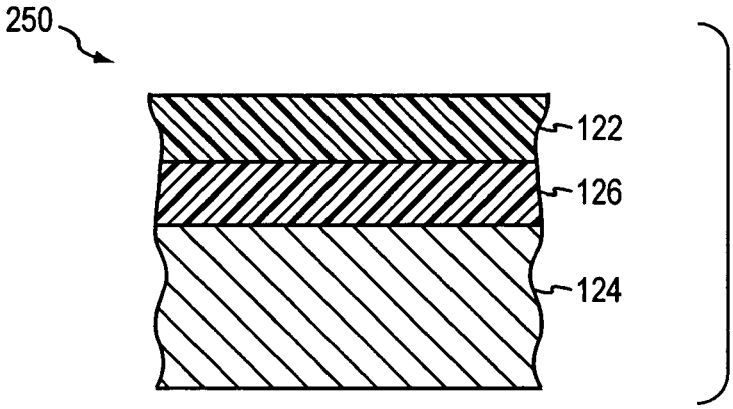
FIG. 8 is an enlarged sectional view of an embodiment of a printing member according to the invention that contains an imaging layer, an intermediate layer, and a substrate.
Figure 9:
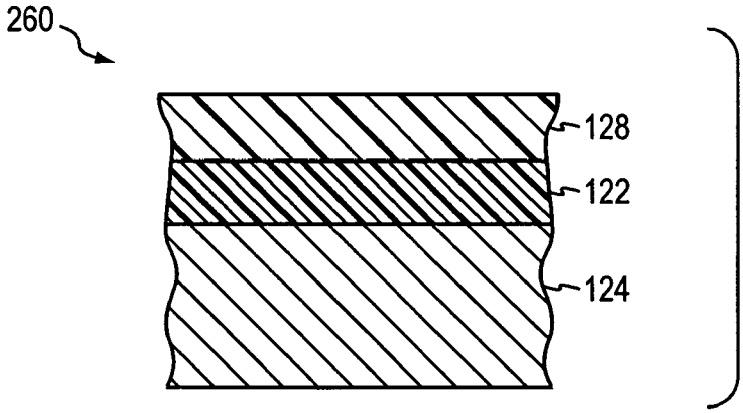
FIG. 9 is an enlarged sectional view of an embodiment of a printing member according to the invention that contains a top layer, an imaging layer, and a substrate.
Figure 10:
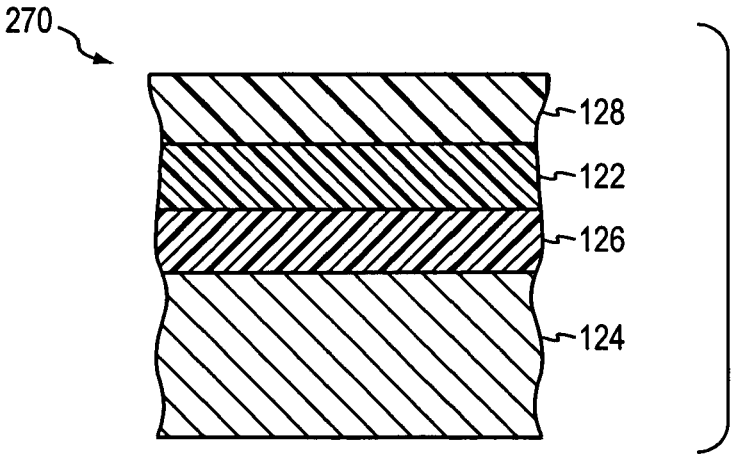
FIG. 10 is an enlarged sectional view of an embodiment of a printing member according to the invention that contains a top layer, an imaging layer, an intermediate layer, and a substrate.

Referring to FIG. 7, another embodiment of a printing member shown at 240 includes an imaging layer 122 that undergoes a transition in response to heat, and a substrate 124, as described above. FIG. 8 illustrates a variation 250 that includes an intermediate layer 126 disposed between the imaging layer 122 and the substrate 124. FIG. 9 illustrates yet another variation 260 that includes a top layer 128 that is permeable to water (or other solvent) and transparent to imaging radiation, as described above. FIG. 10 illustrates a third variation 270 that includes both an intermediate layer 126 and a permeable top layer 128. These layers will now be described in detail.

3.1 Imaging Layer 122

The imaging layer 122 layer captures the image on the printing member by undergoing transition from an insoluble state to a soluble state in response to heat. The imaging layer 122 can be oleophilic or hydrophilic and can include a material that absorbs imaging radiation. Polymers utilized in this layer should exhibit good adhesion to adjacent layers and be highly wear-resistant. Preferably, the non-imaged portions of the imaging layer 122 withstand repeated application of fountain solution during printing without substantial degradation or solubilization.

The transition that the imaging layer 122 undergoes in response to heat may be from an insoluble, crystalline state to a soluble, amorphous state. In some embodiments, substantially all of the imaging layer 122 exposed to the imaging radiation undergoes the transition from an insoluble state to a soluble state. In other embodiments, only a portion of the imaging layer 122 exposed to the imaging radiation undergoes the transition. The transition can be reversible (e.g., a phase change), which allows a printing member according to the invention to be "erased" and re-imaged, as described above.

In general, suitable polymeric materials for use in the imaging layer 122 include those having exposed polar moieties such as hydroxyl or carboxyl groups, various cellulosics modified to incorporate such groups, and polyvinyl alcohol polymers, for example. In a preferred embodiment, the imaging layer 122 includes polyvinyl alcohol.

In designing a suitable formulation, cross-linking can be used to control resolubility, filler pigments to modify and/or control rewettability, and pigments and/or dyes to impart absorbance of laser energy. In particular, fillers such as $TiO_2$ pigments, zirconia, silicas and clays are particularly useful in imparting rewettability without resolubility. In one embodiment, the imaging layer 122 contains a zirconium crosslinking agent, preferably ammonium zirconyl carbonate.

Suitable materials for absorbing IR or near-IR imaging radiation include a wide range of dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.), naphthalocyanines, iron chelates, nickel chelates, oxoindolizines, iminium salts, and indophenols, for example. Any of these materials may be dispersed in a prepolymer before cross-linking into a final film.

The absorbing material should minimally affect adhesion between the imaging layer 122 and adjacent layers. Surface-modified carbon-black pigments sold under the trade designation CAB-O-JET 200 by Cabot Corporation, Bedford, Mass. are found to minimally disrupt adhesion at loading levels providing adequate sensitivity for heating. Another suitable carbon-black pigment is BONJET BLACK CW-1, available from Orient Corporation, Springfield, N.J.

Near-IR absorbers for imaging layers 122 based on polyvinyl alcohol include conductive polymers, e.g., polyanilines, polypyrroles, poly-3,4-ethylenedioxypyrroles, polythiophenes, and poly-3,4-ethylenedioxythiophenes. As polymers, these are incorporated into the imaging layer 122 in the form of dispersions, emulsions, colloids, etc. due to their limited solubility. Alternatively, they can be formed in situ from monomeric components included in the imaging layer 122 as cast or applied to the imaging layer 122 subsequent to the curing process—i.e., by a post-impregnation or saturation process. For conductive polymers based on polypyrroles, the catalyst for polymerization conveniently provides the "dopant" that establishes conductivity.

Certain inorganic absorbers, dispersed within the polymer matrix, also serve particularly well in connection with imaging layers 122 based on polyvinyl alcohol. These include TiON, TiCN, tungsten oxides of chemical formula $WO_{3-x}$, where $0<x<0.5$ (with $2.7 \leqq x \leqq 2.9$ being preferred), and vanadium oxides of chemical formula $V_2O_{5-x}$, where $0<x<1.0$ (with $V_6O_{13}$ being preferred).

3.2 Substrate 124

The substrate 124 provides dimensionally stable mechanical support to the printing member and possibly dissipates heat accumulated in the imaging layer 122 to prevent its ablation. The substrate 124 can be either hydrophilic or oleophilic. The substrate 106 in any of the embodiments 240–270 may be fabricated using any of the materials and methods described above.

In embodiments of the invention that do not include an intermediate layer 126 between the imaging layer 122 and the substrate 124 (e.g. FIGS. 7 and 9), the imaging layer 122 and the substrate 124 have opposite affinities for ink and/or a liquid to which ink will not adhere. In embodiments that contain an intermediate layer 126 (e.g. FIGS. 8 and 10), on the other hand, the imaging layer 122 and the substrate 124 need not have opposite lithographic affinities, because the imaging layer 122 and the intermediate layer 126 have opposite affinities, as described below. However, it is preferable to provide a substrate 124 and an intermediate layer 126 of like affinities to promote adhesion and to accommodate damage to the intermediate layer 126 without loss of performance. Specifically, even though the intermediate layer 126 is typically not soluble in aqueous solutions and is not removed during the imaging process, it can still be scratched or damaged during the printmaking process. A substrate 124 of like affinity will accept or reject ink in the same manner as the overlying intermediate layer 126 in those areas where the intermediate layer 126 is damaged, thus maintaining print quality and prolonging the press life of the printing member.

3.3 Optional Intermediate Layer 126

The optional intermediate layer 126 is located between the substrate 124 and the imaging layer 122. The intermediate layer 126 can be either hydrophilic or oleophilic, provided that it has an affinity opposite to that of the imaging layer 122 for at least one of ink and a liquid to which ink will not adhere. It should adhere well to the substrate 124 and to the imaging layer 122 and should withstand repeated application of fountain solution during printing without substantial degradation or solubilization.

In some embodiments, the intermediate layer 126 is equivalent to the third layer 118 described above. In these embodiments, the intermediate layer 126 provides a thermal barrier during laser exposure to prevent heat loss and possible damage to the substrate 124. In other embodiments, the intermediate layer 126 absorbs imaging radiation so as to impart heat to the imaging layer 122, facilitating its transition. The intermediate layer 126 may (but need not) include a material that absorbs imaging radiation and transfers thermal energy to the imaging layer 122. When IR or near-IR imaging radiation is employed, suitable absorbing materials can include a wide range of dyes and pigments, as described above. In addition, the absorbing material should minimally affect adhesion between the intermediate layer 124 and adjacent layers. The intermediate layer 126 in any of the embodiments 240–270 may be fabricated using any of the materials and methods described above.

3.4 Optional Top Layer 128

The optional top layer 128 is located above the imaging layer 122 and is designed to be more robust on press and more scratch-resistant than the imaging layer 122, thus maintaining print quality and prolonging the press life of the printing member. The top layer 128 includes a polymer that is permeable to water (or other solvent) and yet resistant to solubilization by aqueous solvents. Polymers utilized in this layer should be transparent to imaging radiation and have the same affinity as the imaging layer 122 for ink and/or a liquid to which ink will not adhere. The top layer 128 in any of the embodiments 240–270 may be fabricated using any of the materials and methods described above.

4. Imaging Techniques

Figure 11A:
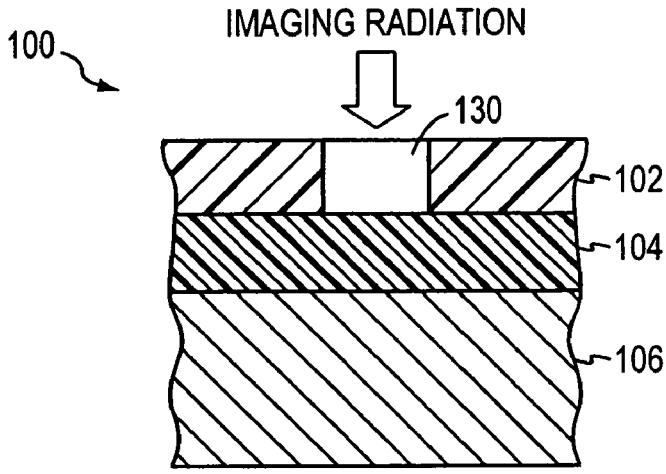
FIGS. 11A–11C are enlarged sectional views of the printing member of FIG. 1 illustrating an imaging mechanism according to the invention.
Figure 11B:
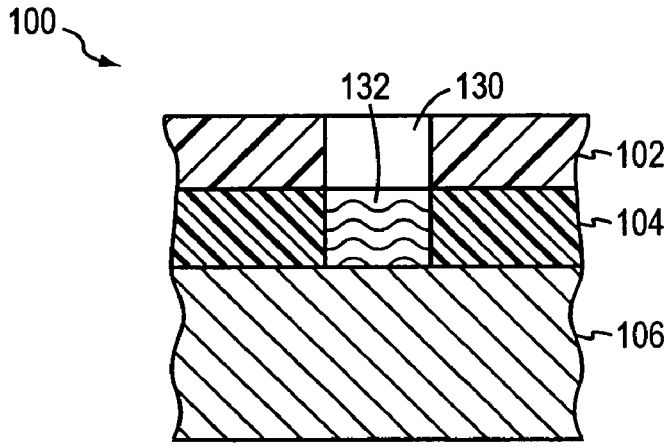
Figure 11C:
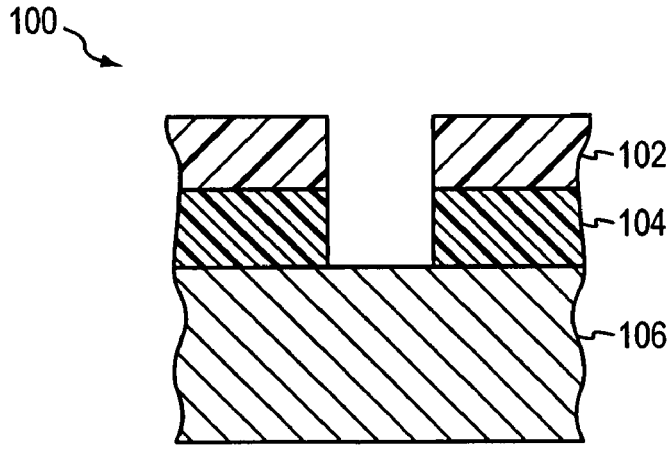

FIGS. 11A–11C illustrate the consequences of imaging an embodiment of printing member 100, wherein substantially all of the second layer 104 exposed to the imaging radiation changes phase. In one embodiment, the first layer 102 of the printing member 100 contains a material that absorbs imaging radiation. As illustrated in FIG. 11A, the exposed area 130 of the first layer 102 absorbs the imaging pulse and converts the energy to heat. With reference to FIG. 11B, the heat is transferred to the portion 132 of the second layer 104 immediately below the exposed area 130 of the first layer 102, causing substantially all of the portion 132 of the second layer 104 to change from an insoluble state to a soluble state. A solvent (e.g., an aqueous fluid) applied to the printing member 100 post-imaging permeates the first layer 102 and dissolves the soluble portion 132 of the second layer 104. The dissolved portion 132 of the second layer 104, along with the portion 130 of the first layer 102 that overlies it, can then be removed (e.g., by rubbing or as a consequence of the mechanical action that takes place during the print "make ready" process) to expose the substrate 106 below, as illustrated in FIG. 11C.

Figure 12A:
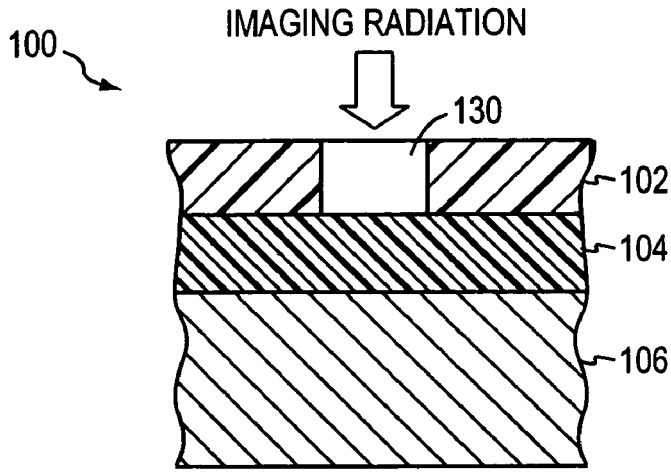
FIGS. 12A–12C are enlarged sectional views of the printing member of FIG. 1 illustrating another imaging mechanism according to the invention.
Figure 12B:
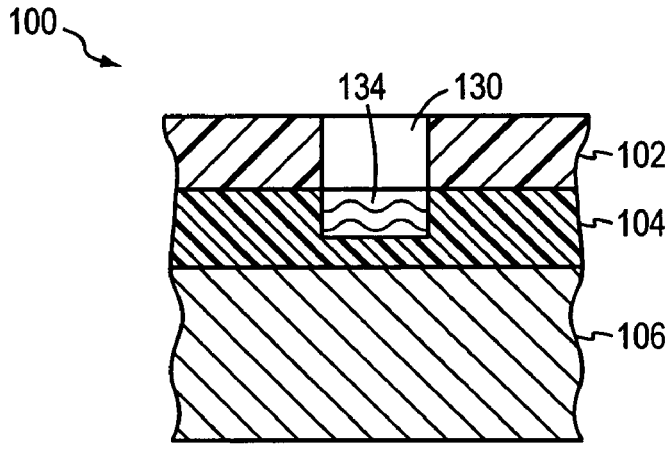
Figure 12C:
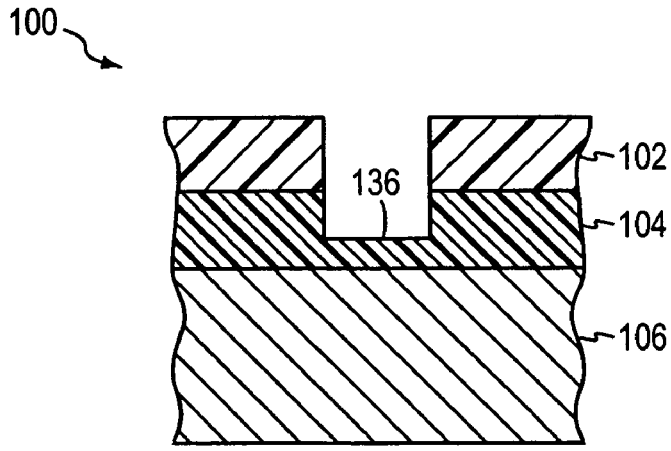

FIGS. 12A–12C illustrate the consequences of imaging another embodiment of the printing member 100, wherein only a portion of the second layer 104 exposed to the imaging radiation undergoes transition. In one embodiment, the first layer 102 of the printing member 100 contains a material that absorbs imaging radiation. As illustrated in FIG. 12A, the exposed area 130 of the first layer 102 absorbs the imaging pulse and converts the energy to heat. Referring to FIG. 12B, the heat is transferred to the second layer 104 immediately below the exposed area 130 of the first layer 102, causing only a portion 134 of the second layer 104 to change from an insoluble state to a soluble state. An aqueous fluid applied to the printing member 100 post-imaging permeates the first layer 102 and dissolves the soluble portion 134 of the second layer 104. The dissolved portion 134 of the second layer 104, along with the portion 130 of the first layer 102 that overlies it, can then be removed (e.g. by rubbing or as a consequence of the mechanical action that takes place during the print "make ready" process) to expose the remaining portion 136 of the second layer 104 below, as illustrated in FIG. 12C.

In other embodiments, the second layer 104 of the printing member 100 contains a material that absorbs imaging radiation. In these embodiments, the imaging pulse passes through the first layer 102 and is absorbed by the second layer 104, causing the transition described above.

In still other embodiments, both the first and second layers 102 and 104 contain absorbing material. In these embodiments, the exposed areas of the first layer 102 absorb the imaging pulse and convert the energy to heat, which is transferred to the second layer 104. Any imaging radiation that is not absorbed by the first layer 102 is absorbed by the second layer 104, causing the transition described above.

Figure 13A:
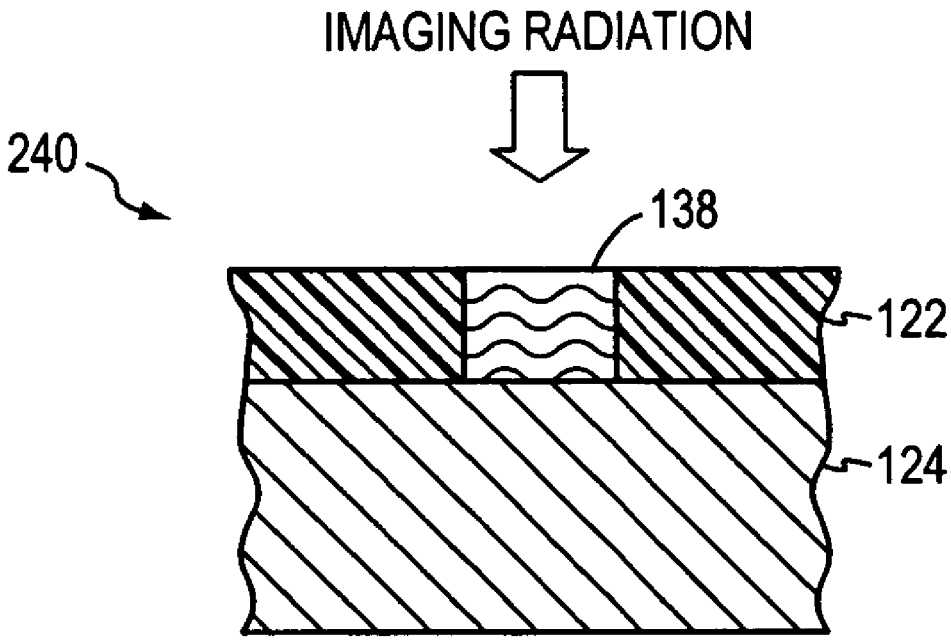
FIGS. 13A–13B are enlarged sectional views of the printing member of FIG. 7 illustrating an imaging mechanism according to the invention.
Figure 13B:
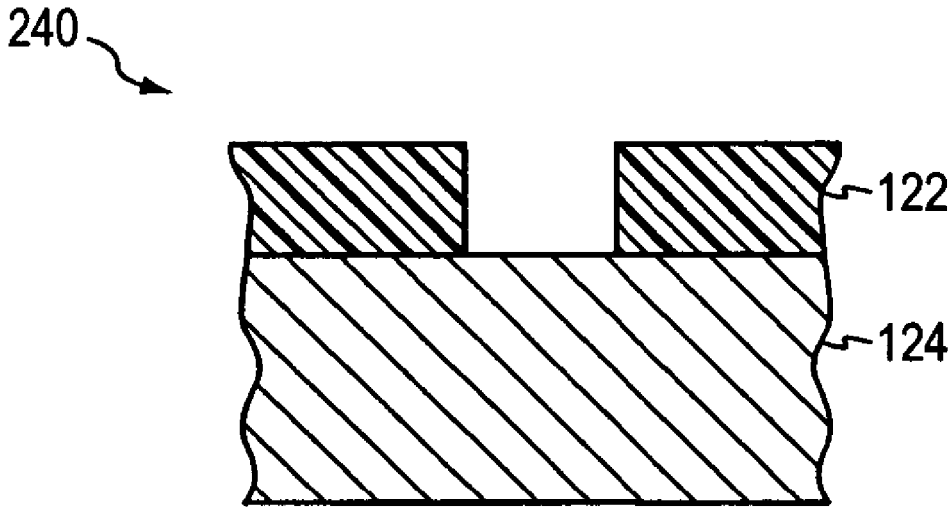

FIGS. 13A and 13B illustrate the consequences of exposing an embodiment of the printing member 240 to the output of an imaging laser. As illustrated in FIG. 13A, the exposed portion 138 of the imaging layer 122 absorbs the imaging pulse and converts the energy to heat, causing the exposed portion 138 to change from an insoluble state to a soluble state. A solvent (e.g., an aqueous fluid) applied to the printing member 250 post-imaging dissolves the soluble portion 138 of the imaging layer 122. The dissolved portion 138 of the imaging layer 122 can then be removed to expose the substrate 124 below, as illustrated in FIG. 13B.

Figure 14A:
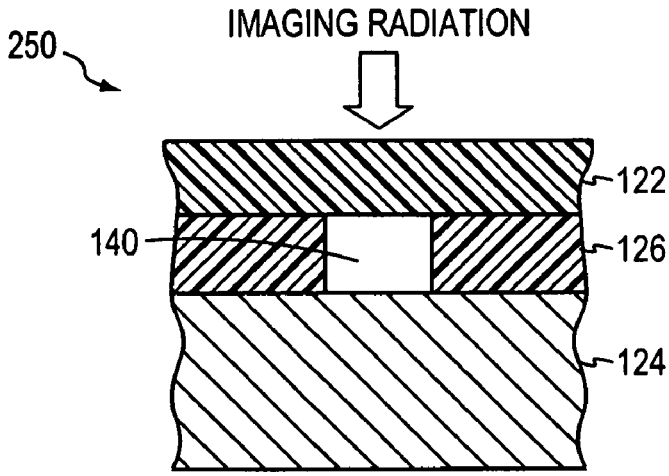
FIGS. 14A–14C are enlarged sectional views of the printing member of FIG. 8 illustrating an imaging mechanism according to the invention.
Figure 14B:
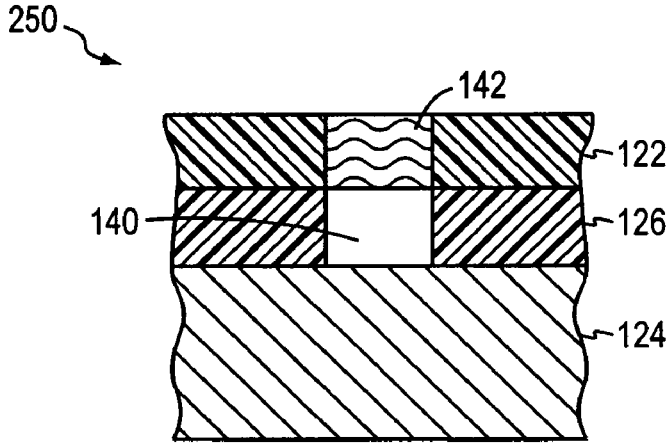
Figure 14C:
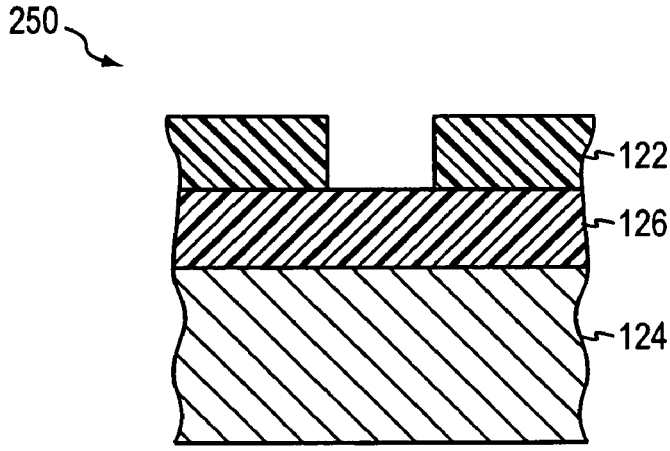

FIGS. 14A–14C illustrate the consequences of exposing an embodiment of the printing member 250 to the output of an imaging laser. In the illustrated embodiment, the imaging layer 122 is transparent to the imaging radiation. As illustrated in FIG. 14A, the exposed area 140 of the intermediate layer 126 absorbs the imaging pulse and converts the energy to heat. Referring to FIG. 14B, the heat is transferred to the portion 142 of the imaging layer 122 immediately above the exposed area 140 of the intermediate layer 126, causing substantially all of the portion 142 of the imaging layer 122 to change from an insoluble state to a soluble state. A solvent (e.g., an aqueous fluid) applied to the printing member 250 post-imaging dissolves the soluble portion 142 of the imaging layer 122. The dissolved portion 142 of the imaging layer 122 can then be removed (e.g., by rubbing or as a consequence of the mechanical action that takes place during the print "make ready" process) to expose the intermediate layer 126 below, as illustrated in FIG. 14C.

Figure 15A:
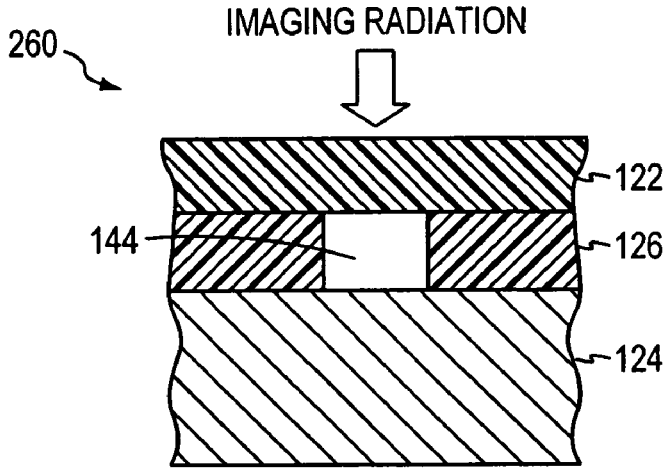
FIGS. 15A–15C are enlarged sectional views of the printing member of FIG. 8 illustrating another imaging mechanism according to the invention.
Figure 15B:
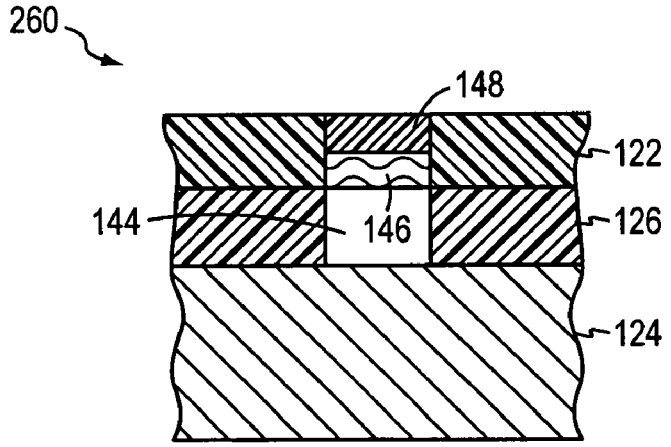
Figure 15C:
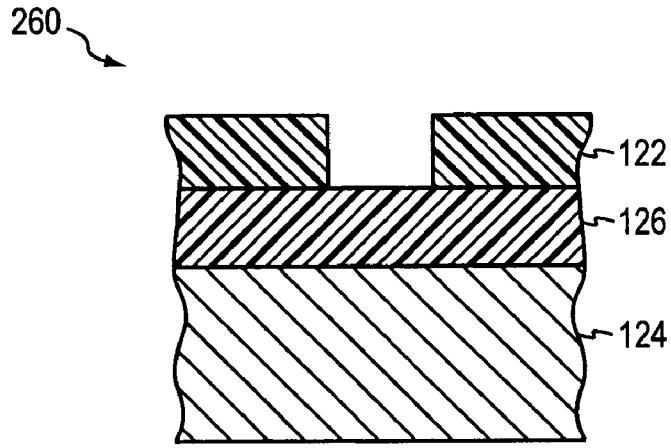

FIGS. 15A–15C illustrate a variation of the process described in FIGS. 14A–14C, wherein only a portion 146 of the imaging layer 122 undergoes a transition in response to imaging radiation. As illustrated in FIG. 15A, the exposed area 144 of the intermediate layer 126 absorbs the imaging pulse and converts the energy to heat. With reference to FIG. 15B, the heat is transferred to the imaging layer 122 immediately above the exposed area 144 of the intermediate layer 126, causing only a portion 146 of the imaging layer 122 to change from an insoluble state to a soluble state. A solvent (e.g., an aqueous fluid) applied to the printing member 260 post-imaging permeates the remaining insoluble portion 148 of the imaging layer 122 and dissolves the soluble portion 146. The dissolved portion 146 of the imaging layer 122, along with the remaining insoluble portion 148 that overlies it, can then be removed (e.g. by rubbing or as a consequence of the mechanical action that takes place during the print "make ready" process) to expose the intermediate layer 126 below, as illustrated in FIG. 15C.

In all embodiments of the invention, the imaging pulse delivers the proper amount of energy to the printing member to cause the desired transition. The amount of energy required is a function of parameters such as laser power, the duration of the pulse, the intrinsic absorption of the heat-sensitive layer (as determined, for example, by the concentration of absorber therein), the thickness of the heat-sensitive layer, and the presence of a thermally conductive layer beneath the heat-sensitive layer. These parameters are readily determined by the skilled practitioner without undue experimentation.

It will be seen that the foregoing techniques provide a basis for improved lithographic printing and superior plate constructions. The terms and expressions employed herein are used as terms of description and not of limitation, and there is no intention in the use of such terms and expressions of excluding any equivalents of the features shown and described or portions thereof. Instead, it is recognized that various modifications are possible within the scope of the invention claimed.

What is claimed is:

1. A method of imaging a lithographic printing member, the method comprising the steps of:

(a) providing a printing member having a first layer, a second layer thereunder, and a substrate beneath the second layer, wherein (i) the first layer is permeable to a solvent, (ii) in response to heat, the second layer undergoes a transition from an insoluble state to a soluble state, and (iii) the first layer and at least one of the second layer and the substrate have opposite affinities for at least one of ink and a liquid to which ink will not adhere;

(b) exposing the printing member to imaging radiation in an imagewise pattern so as to cause at least a portion of the second layer exposed to the imaging radiation to undergo the transition;

(c) subjecting the printing member to a solvent, the solvent permeating the first layer and dissolving soluble portions of the second layer; and (d) removing the first layer where the printing member received radiation, thereby creating an imagewise lithographic pattern on the printing member.

2. The method of claim 1 wherein the insoluble state is crystalline.

3. The method of claim 1 wherein the soluble state is amorphous.

4. The method of claim 1 wherein the first layer comprises a material that absorbs imaging radiation and transfers heat to the second layer.

5. The method of claim 4 wherein the material comprises a polymer and an IR-absorbing pigment dispersed therein.

6. The method of claim 4 wherein the material comprises a polymer and an IR-absorbing dye dispersed therein.

7. The method of claim 1 wherein the second layer comprises a material that absorbs imaging radiation.

8. The method of claim 7 wherein the material comprises a polymer and an IR-absorbing pigment dispersed therein.

9. The method of claim 7 wherein the material comprises a polymer and an IR-absorbing dye dispersed therein.

10. The method of claim 1 wherein the first and second layers comprise a material that absorbs imaging radiation.

11. The method of claim 1 wherein the second layer comprises polyvinyl alcohol.

12. The method of claim 1 wherein the first layer and the substrate have opposite affinities for at least one of ink and a liquid to which ink will not adhere.

13. The method of claim 12 wherein the first layer and the second layer have opposite affinities for at least one of ink and a liquid to which ink will not adhere.

14. The method of claim 12 wherein the first layer and the second layer have the same affinities for at least one of ink and a liquid to which ink will not adhere.

15. The method of claim 1 wherein the first layer and the substrate have the same affinities for at least one of ink and a liquid to which ink will not adhere.

16. The method of claim 15 wherein the first layer and the second layer have opposite affinities for at least one of ink and a liquid to which ink will not adhere.

17. The method of claim 1 wherein substantially all of the second layer exposed to the imaging radiation undergoes the transition.

18. The method of claim 1 wherein a portion of the second layer exposed to the imaging radiation undergoes the transition.

19. The method of claim 1 wherein the substrate comprises a metal.

20. The method of claim 1 wherein the substrate comprises a polymer.

21. The method of claim 1 wherein the printing member further comprises a third layer between the second layer and the substrate.

22. The method of claim 1 wherein the printing member further comprises a top layer disposed above the first layer, the top layer being permeable to a solvent, transparent to imaging radiation, and having the same affinity as the first layer for at least one of ink and a liquid to which ink will not adhere.

23. The method of claim 1 wherein the portions of the first layer where the printing member received radiation are removed with an aqueous solution.

24. The method of claim 1 wherein the transition is a phase change from a water-insoluble state to a water-soluble state and the solvent is an aqueous fluid.

25. A method of imaging a lithographic printing member, the method comprising the steps of:

(a) providing a printing member having an imaging layer and an oleophilic substrate thereunder, wherein in response to heat, at least a portion of the imaging layer undergoes a transition from an insoluble state to a soluble state;

(b) exposing the printing member to imaging radiation in an imagewise pattern so as to cause the imaging layer to undergo the transition;

(c) subjecting the printing member to an aqueous fluid, the aqueous fluid dissolving soluble portions of the imaging layer; and (d) removing the imaging layer where the printing member received radiation, thereby creating an imagewise lithographic pattern on the printing member.

26. The method of claim 25 wherein the water-insoluble state is crystalline.

27. The method of claim 25 wherein the soluble state is amorphous.

28. The method of claim 25 wherein the imaging layer comprises a polymer and an IR-absorbing pigment dispersed therein.

29. The method of claim 25 wherein the imaging layer comprises a polymer and an IR-absorbing dye dispersed therein.

30. The method of claim 25 wherein the imaging layer and the substrate have opposite affinities for at least one of ink and a liquid to which ink will not adhere.

31. The method of claim 25 wherein the imaging layer and the substrate have the same affinities for at least one of ink and a liquid to which ink will not adhere.

32. The method of claim 25 wherein substantially all of the imaging layer exposed to the imaging radiation undergoes the transition.

33. The method of claim 25 wherein a portion of the imaging layer exposed to the imaging radiation undergoes the transition.

34. The method of claim 25 wherein the substrate comprises a metal.

35. The method of claim 25 wherein the substrate comprises a polymer.

36. The method of claim 25 wherein the printing member further comprises an intermediate layer between the imaging layer and the substrate, the intermediate layer having an affinity opposite to that of the imaging layer for at least one of ink and a liquid to which ink will not adhere.

37. The method of claim 25 wherein the printing member further comprises a top layer disposed above the imaging layer, the top layer being permeable to an aqueous fluid, transparent to imaging radiation, and having the same affinity as the imaging layer for at least one of ink and a liquid to which ink will not adhere.

38. The method of claim 25 wherein the portions of the imaging layer where the printing member received radiation are removed with an aqueous solution.

39. A lithographic imaging member comprising:

(a) a first layer that is permeable to an aqueous fluid;

(b) a second layer thereunder, wherein at least a portion of the second layer undergoes a transition from an insoluble state to a soluble state in response to heat; and (c) a substrate beneath the second layer, wherein the first layer and at least one of the second layer and the substrate have opposite affinities for at least one of ink and a liquid to which ink will not adhere.

40. The member of claim 39 wherein the water-insoluble state is crystalline.

41. The member of claim 39 wherein the soluble state is amorphous.

42. The member of claim 39 wherein the first layer comprises a material that absorbs imaging radiation and transfers heat to the second layer.

43. The member of claim 42 wherein the material comprises a polymer and an IR-absorbing pigment dispersed therein.

44. The member of claim 42 wherein the material comprises a polymer and an IR-absorbing dye dispersed therein.

45. The member of claim 39 wherein the second layer comprises a material that absorbs imaging radiation.

46. The member of claim 45 wherein the material comprises a polymer and an IR-absorbing pigment dispersed therein.

47. The member of claim 45 wherein the material comprises a polymer and an IR-absorbing dye dispersed therein.

48. The member of claim 39 wherein the first and second layers comprise a material that absorbs imaging radiation.

49. The member of claim 39 wherein the second layer comprises polyvinyl alcohol.

50. The member of claim 39 wherein the first layer and the substrate have opposite affinities for at least one of ink and a liquid to which ink will not adhere.

51. The member of claim 50 wherein the first layer and the second layer have opposite affinities for at least one of ink and a liquid to which ink will not adhere.

52. The member of claim 50 wherein the first layer and the second layer have the same affinities for at least one of ink and a liquid to which ink will not adhere.

53. The member of claim 39 wherein the first layer and the substrate have the same affinities for at least one of ink and a liquid to which ink will not adhere.

54. The member of claim 53 wherein the first layer and the second layer have opposite affinities for at least one of ink and a liquid to which ink will not adhere.

55. The member of claim 39 wherein substantially all of the second layer exposed to the imaging radiation undergoes the transition.

56. The member of claim 39 wherein a portion of the second layer exposed to the imaging radiation undergoes the transition.

57. The member of claim 39 wherein the substrate comprises a metal.

58. The member of claim 39 wherein the substrate comprises a polymer.

59. The member of claim 39 further comprising a third layer between the second layer and the substrate.

60. The member of claim 39 further comprising a top layer disposed above the first layer, the top layer being permeable to an aqueous fluid, transparent to imaging radiation, and having the same affinity as the first layer for at least one of ink and a liquid to which ink will not adhere.

61. A lithographic imaging member comprising:

(a) an imaging layer; and (b) an oleophilic substrate beneath the imaging layer, wherein at least a portion of the imaging layer undergoes a transition from a water insoluble state to a water soluble state in response to heat.

62. The member of claim 61 wherein the water-insoluble state is crystalline.

63. The member of claim 61 wherein the soluble state is amorphous.

64. The member of claim 61 wherein the imaging layer comprises a polymer and an IR-absorbing pigment dispersed therein.

65. The member of claim 61 wherein the imaging layer comprises a polymer and an IR-absorbing dye dispersed therein.

66. The member of claim 61 wherein the imaging layer and the substrate have opposite affinities for at least one of ink and a liquid to which ink will not adhere.

67. The member of claim 61 wherein the imaging layer and the substrate have the same affinities for at least one of ink and a liquid to which ink will not adhere.

68. The method of claim 61 wherein substantially all of the imaging layer exposed to the imaging radiation undergoes the transition.

69. The method of claim 61 wherein a portion of the imaging layer exposed to the imaging radiation undergoes the transition.

70. The member of claim 61 wherein the substrate comprises a metal.

71. The member of claim 61 wherein the substrate comprises a polymer.

72. The member of claim 61 further comprising an intermediate layer between the imaging layer and the substrate, the intermediate layer having an affinity opposite to that of the imaging layer for at least one of ink and a liquid to which ink will not adhere.

73. The member of claim 61 further comprising a top layer disposed above the imaging layer, the top layer being permeable to an aqueous fluid, transparent to imaging radiation, and having the same affinity as the imaging layer for at least one of ink and a liquid to which ink will not adhere.

* * * * *